United States Patent [19]

von Hagen

[11] Patent Number: 4,633,795

[45] Date of Patent: Jan. 6, 1987

[54] LOOPER THREAD CONTROL WITH ANTI-SPIN CUTTING KNIVES

[75] Inventor: Wolf R. von Hagen, Hemmingen, Fed. Rep. of Germany

[73] Assignee: Union Special G.m.b.H., Stuttgart, Fed. Rep. of Germany

[21] Appl. No.: 840,804

[22] Filed: Mar. 18, 1986

[30] Foreign Application Priority Data

Mar. 22, 1985 [DE] Fed. Rep. of Germany ..... 3510332

[51] Int. Cl.[4] ..... D05B 49/04

[52] U.S. Cl. ..... 112/248; 112/302

[58] Field of Search ..... 112/302, 253, 254, 199, 112/200, 285, 248; 242/19, 21

[56] References Cited

U.S. PATENT DOCUMENTS

| | | | |
|---|---|---|---|
| 1,947,333 | 2/1934 | Clayton | 112/248 |
| 2,006,055 | 6/1935 | McKean | 242/19 |
| 2,095,212 | 10/1937 | Clayton | 112/248 |
| 2,186,534 | 1/1940 | Le Vesconte | 112/248 |
| 4,325,314 | 4/1982 | Niem. | |
| 4,492,174 | 1/1985 | Kaufmann | 112/248 |

FOREIGN PATENT DOCUMENTS

| | | |
|---|---|---|
| 1020852 | 12/1957 | Fed. Rep. of Germany. |
| 1455633 | 11/1976 | United Kingdom. |

*Primary Examiner*—H. Hampton Hunter
*Attorney, Agent, or Firm*—Powell L. Sprunger

[57] ABSTRACT

A thread control device comprising, a rotatable disc assembly for controlling a thread and having a rotational axis. The device has a knife located on at least one side of the disc assembly and having a cutting edge disposed generally parallel to the rotational axis of the disc assembly.

16 Claims, 4 Drawing Figures

FIG. 1
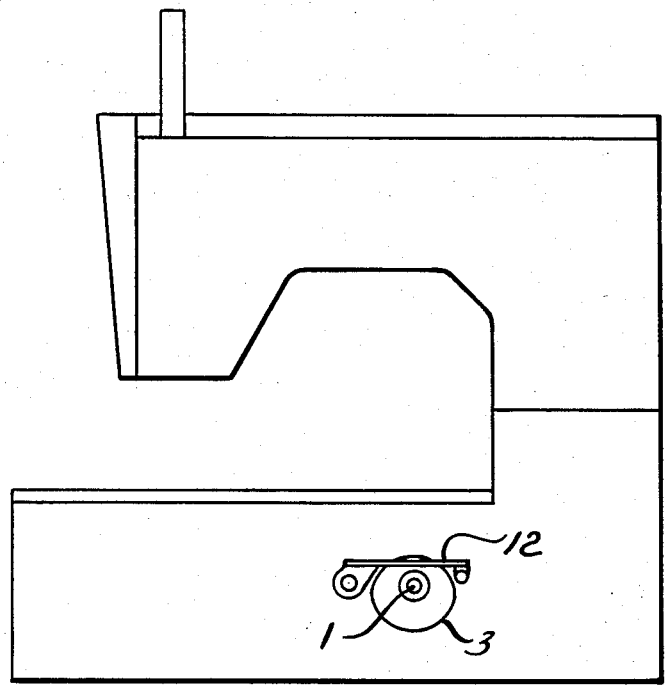
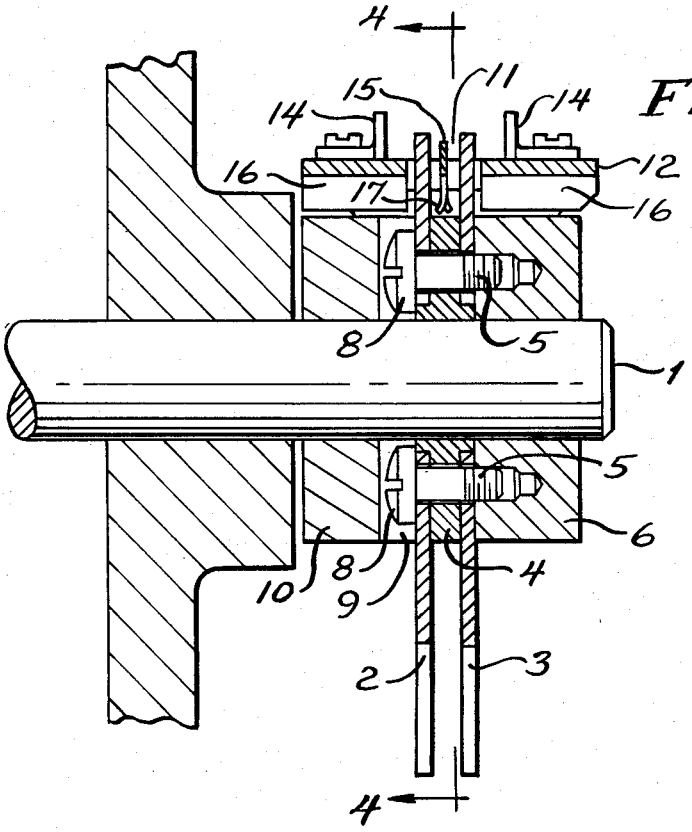
FIG. 3

LOOPER THREAD CONTROL WITH ANTI-SPIN CUTTING KNIVES

BACKGROUND OF THE INVENTION

The present invention relates to a looper thread control device for a chain stitch sewing machine.

Looper thread control devices for a chain stitch sewing machine are known. In such devices, a looper thread is fed between thread eyes across rotatable discs which, as a result of their contour, feed thread to and from the looper in order to cause perfect stitch formation.

However, these thread control devices can be disadvantageous if the looper thread breaks. If the thread breaks in known looper thread control devices, the rotating discs may pick up the loose thread and wind it up. By the time the operator has noticed the break, a large quantity of thread may already be wound up, thus requiring a long period of time to remove the wound thread.

In order to prevent the broken thread from being wound up, it has been proposed to clamp the looper thread in front of the discs such that the thread can be broken off should it start to be wound up. However, this device is relatively expensive, since it requires parts which move in synchronism with the stitch formation.

SUMMARY OF THE INVENTION

A principal feature of the present invention is the provision of an improved thread control device for a chain stitch sewing machine.

The thread control device comprises, a pair of spaced rotatable discs having a rotational axis, and a cover plate through which the discs project. The device has a pair of thread eyes extending from the cover plate on opposed sides of the discs. The device has a pair of knives on opposed sides of the discs and extending from the cover plate toward the rotational axis, with the knives extending to a location near the discs and having cutting edges which are generally parallel to the rotational axis of the discs. The device has a tongue located intermediate the discs, with the tongue having lower teeth with sharp edges, and with alternate teeth being disposed in opposite directions toward the discs.

A feature of the invention is that the knives cut the thread in the event that a broken thread begins to wind up on the device on opposed sides of the discs.

Another feature of the invention is that the teeth on the tongue cut the thread in the event that the thread begins to wind up inside of the discs.

A further feature of the invention is that the device thus prevents a broken thread from becoming wound up on the device.

Still another feature of the invention is that the device is of simplified construction.

Yet another feature of the invention is that the device can be disassembled and reassembled in a simplified manner.

Further features will become more fully apparent in the following description of the embodiments of this invention and from the appended claims.

DESCRIPTION OF THE DRAWINGS

In the drawings:

FIG. 1 is a front elevational view of a chain stitch sewing machine showing a looper thread control device of the present invention;

FIG. 3 is a fragmentary sectional view taken substantially as indicated along the line 3—3 of FIG. 2.

DESCRIPTION OF THE PREFERRED EMBODIMENTS

Figure 2:
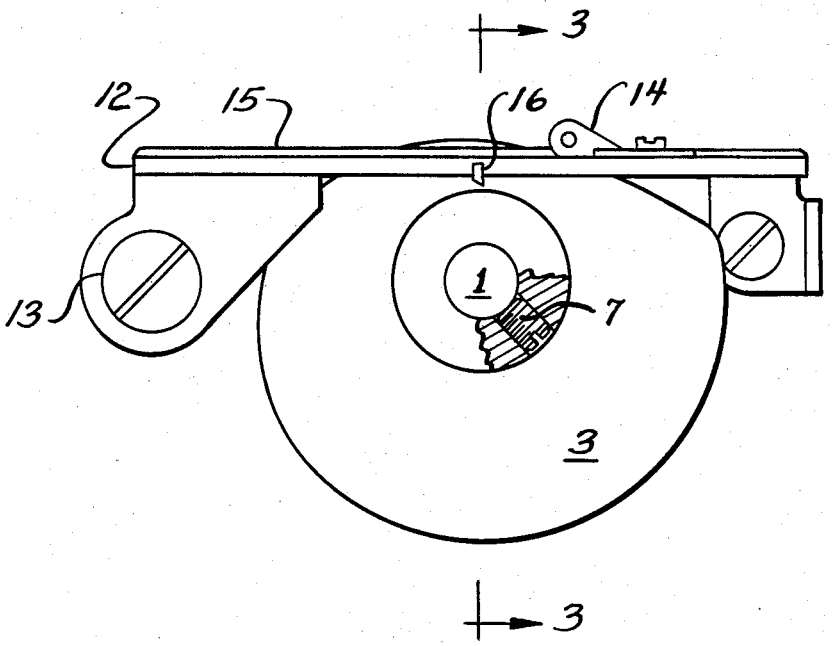
FIG. 2 is an enlarged elevational view, taken partly in section, of the looper thread control device.
Figure 4:
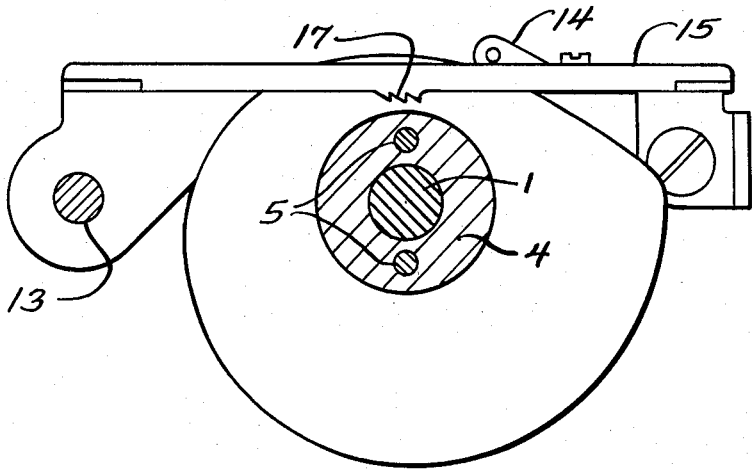
FIG. 4 is a sectional view taken substantially as indicated along the line 4—4 of FIG. 3.

Referring now to FIGS. 1–4, there is shown a looper thread control device for a chain stitch sewing machine. The thread control device has a pair of discs or cams 2 and 3 mounted on a rotatable shaft 1, with the discs 2 and 3 being maintained in a spaced relationship by a spacer 4. The discs 2 and 3 and spacer 4 are secured by screws 5 to a collar 6 which is fastened by a clamping screw 7 to the shaft 1. The heads 8 of the screws 5 are positioned in a groove 9 of a hub 10 which is also secured to the shaft 1.

The discs 2 and 3 pass through a slot 11 in a cover plate 12 which is pivotally attached to a bolt 13 which is mounted on the sewing machine housing. The cover plate 12 has a pair of thread eyes 14 on opposed sides of the discs 2 and 3. A tongue 15, which projects above the plate 12, is located between the discs 2 and 3.

The thread control device has a pair of knives 16 secured to the lower side of the plate 12, with the knives 16 having lower sharp cutting edges disposed generally parallel to the rotational axis of the shaft 1 and discs 2 and 3, and with the knives 16 extending to a location near the discs 2 and 3. The knives are received in lower recesses of the cover plate 12. The lower side of the tongue 15 has a plurality of downwardly directed sharp teeth 17, with alternate teeth disposed in opposite directions such that they extend to a location close to the discs 2 and 3, with the lower side of the teeth 17 also being located near the spacer 4.

In use of the sewing machine, a thread passes through the thread eyes 14 to a looper (not shown) which is utilized to form stitches. The rotating discs take up slack on the thread so that perfect stitches may be formed. In the event of a broken thread, the loose end of the thread may fall down on the thread control device, and may catch somewhere on the rotating part of the device and thus begin to wrap around the device. In the event that the thread begins to wind around the collar 6, shaft 1, or hub 10 outside of the discs 2 and 3, then the knives 16 on opposides sides of the discs 2 and 3 cut thread to prevent the thread from winding upon this part of the device on either side of the discs 2 and 3. In the event that the thread begins to wind around the spacer 4 inside of the discs 2 and 3, then the teeth 17 on the tongue 15 cut the thread to prevent the thread from winding inside of the discs 2 and 3.

If required for any reason, the device may be readily disassembled and assembled. First, the plate 12 is raised, and the screws 5 and 7 are loosened. During reassembly, the parts are returned to their previous position by engaging the screw heads 8 in the groove 9.

The foregoing detailed description is given for clearness of understanding only, and no unnecessary limatations should be understood therefrom, as modifications will be obvious to those skilled in the art.

I claim:

1. A thread control device comprising:

rotatable disc means for controlling a thread and having a rotational axis; and a pair of knives located on opposed sides of the disc means and having cutting edges disposed generally parallel to the rotational axis of the disc means.

2. The device of claim 1 wherein the knives are spaced from and directed toward the rotational axis.

3. The device of claim 1 wherein the knives extend to a location near the disc means.

4. A thread control device, comprising:

a pair of spaced rotatable discs for controlling a thread and having a rotational axis; and a pair of knives located on opposed sides of the discs and having cutting edges disposed generally parallel to the rotational axis of the discs.

5. The device of claim 4 including a tongue located between the discs and having cutting teeth located adjacent the discs.

6. A thread control device, comprising:

a pair of spaced rotatable discs for controlling a thread and having a rotational axis; and a tongue located between the discs, and having a plurality of cutting teeth spaced from the rotational axis.

7. The device of claim 6 wherein alternate teeth of the tongue are disposed in opposite directions.

8. The device of claim 7 wherein edges of the teeth extend to a location close to the discs.

9. The device of claim 7 including a spacer intermediate the discs, and in which edges of the teeth are located near the spacer.

10. A thread control device, comprising:

a pair of spaced rotatable discs and having a rotational axis;

a cover plate having a slot through which the discs project;

a pair of thread eyes extending from the cover plate on opposed sides of the discs; and a pair of knives on opposed sides of the discs and extending from the cover plate toward the rotational axis, said knives extending to a location near the discs and having cutting edges which are generally parallel to the rotational axis of the discs.

11. The device of claim 10 in which the knives are received in recesses of the cover plate.

12. The device of claim 10 including a tongue located intermediate the discs, said tongue having lower teeth with sharp edges.

13. The device of claim 12 in which alternate teeth are disposed in opposite directions toward the discs.

14. The device of claim 10 including a spacer intermediate the discs, a collar on one side of the discs and secured to a shaft by a clamping screw, and in which the discs and the spacer are secured to the collar by screws.

15. The device of claim 14 including a hub on the other side of the discs secured to the shaft, and in which heads of the screws which secure the discs and spacer are received in a groove of the hub.

16. A thread control device, comprising:

rotatable disc means for controlling a thread and having a rotational axis; and a knife located on one side of the disc means and having a cutting edge disposed generally parallel to the rotational axis of the disc means.

* * * * *